US007014230B1

(12) United States Patent
Hung

(10) Patent No.: US 7,014,230 B1
(45) Date of Patent: Mar. 21, 2006

(54) STRUCTURE HOIST-USE BASE HOISTING RING

(76) Inventor: Steven Hung, No. 39, 33 Road, Taichung Industrial Park, Taichung county 407 (TW)

( * ) Notice: Subject to any disclaimer, the term of this patent is extended or adjusted under 35 U.S.C. 154(b) by 0 days.

(21) Appl. No.: 10/984,910

(22) Filed: Nov. 10, 2004

(51) Int. Cl.
*B66C 1/66* (2006.01)

(52) U.S. Cl. ..... 294/1.1; 294/89; 403/78; 403/79; 403/164

(58) Field of Classification Search ..... 294/1.1, 294/82.1, 89; 403/78, 79, 119, 164, 165; 410/101
See application file for complete search history.

(56) References Cited

U.S. PATENT DOCUMENTS 5,248,176 A * 9/1993 Fredriksson ..... 294/1.1
6,032,993 A * 3/2000 Kwon ..... 294/1.1
6,267,422 B1 * 7/2001 Alba ..... 294/1.1

* cited by examiner

*Primary Examiner*—Dean J. Kramer
(74) *Attorney, Agent, or Firm*—Troxell Law Office, PLLC

(57) ABSTRACT

An improved structure hoist-use base hoisting ring comprised of a U-shaped clevis movably suspended from the two sides at the lower end of a cylindrical base mount as well as a circular top mounting bushing at the upper section and a bottom mounting bushing at the center section having an upwardly projecting neck and a passageway that are situated over the top and bottom lateral surfaces of a bore through the interior portion of the cylindrical base mount, enabling the installation of a bolt into the top mounting bushing center section and downward through the bottom mounting bushing and the fastening and positioning of its threaded section into the threaded hole of a weight at the lower end. Among the features of the present invention, an annular recess is disposed along the top surface and center section of the cylindrical base mount that provides for the nesting of a flat planar bearing. The center portion opening of the planar bearing is sleeved over the periphery of the neck of the bottom mounting bushing such that its top surface is against the circular top mounting bushing bottom side, enabling the lifting of the load of the weight at the bottom end of the hoisting ring. Since the planar bearing so postured has active rotating capability, the hoisting ring lifting the weight has convenient operation that is adjustable and freely rotatable.

1 Claim, 4 Drawing Sheets

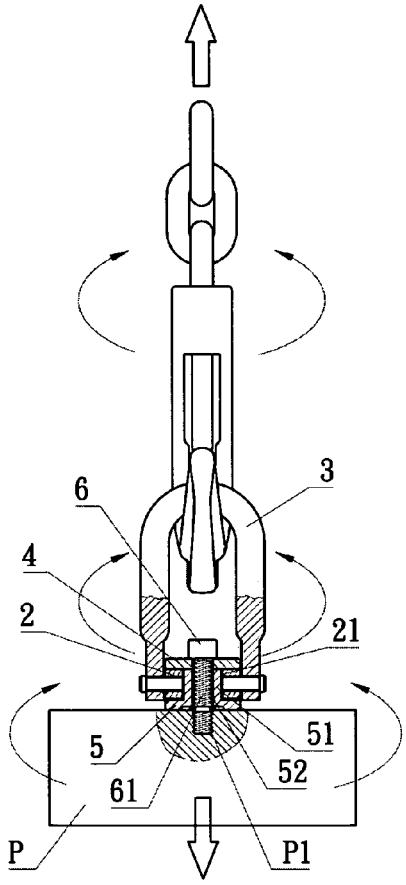
FIG. 1 Prior Art
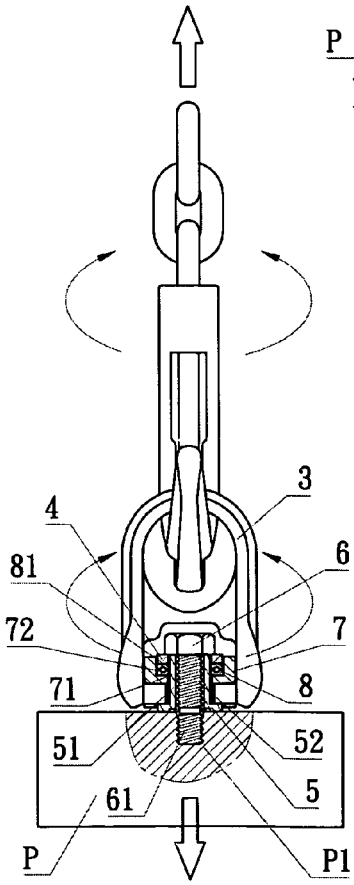
FIG. 4-A
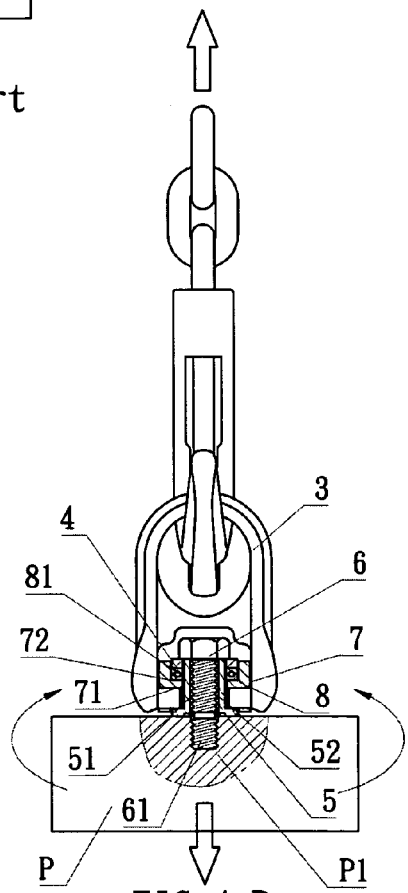
FIG. 4-B

STRUCTURE HOIST-USE BASE HOISTING RING

BACKGROUND OF THE INVENTION

1) Field of the Invention

The invention herein relates to an improved structure hoist-use base hoisting ring, the improved structure of which provides for lifting the load of the weight at the bottom end of the hoisting ring, with the hoisting ring lifting the weight having adjustable rotation capability. Furthermore, the said structure includes a planar bearing nested in a cylindrical base mount and provides for its sleeving over the periphery of the neck of a bottom mounting bushing such that its top surface is against the bottom side of a circular top mounting bushing to thereby achieve simplification and convenience, which is among the features of the present invention.

2) Description of the Prior Art

Hoist-use base hoisting rings are utilized for weight, machined object, and support plate lifting and transporting applications. The conventional structure (referring to FIG. 1) is typically comprised of a U-shaped clevis 3 movably suspended from the two sides at the lower end of a cylindrical base mount 2 as well as a matching circular top mounting bushing 4 at the upper section and a bottom mounting bushing 5 at the center section having an upwardly projecting neck 51 and a passageway 52 that are situated over the top and bottom lateral surfaces of the bore 21 through the interior portion of the cylindrical base mount 2, enabling the installation of a bolt 6 into the top mounting bushing 4 center section and downward through the bottom mounting bushing 5 and the fastening and positioning of its threaded section 61 into the threaded hole P1 of a weight P at the lower end.

However, when chain from a crane installation involved in the lifting operation is connected to the upper extent of the hoisting ring in such a structure, due to the heavy load of the weight P at the bottom end, the fastened bolt 6 is pulled downward such that the top mounting bushing 4, the cylindrical base mount 2, and other components are all in a state of critical stiction; as a result, the interconnective relationship of the top mounting bushing 4, the cylindrical base mount 2, and the bottom mounting bushing 5 is disposed in a revolvable concentrically linked arrangement, but given that each component is subjected to the "vertical downward pulling force" produced by the heaviness of the weight P and thus each component is actually in an "impeded state", the achievement of convenient rotatable operation is not possible.

After the weight P is hoisted and when it is necessary to partially turn or adjust the weight P for machining, inspection, alignment, or other required tasks, the operation is quite strenuous and difficult, and even essentially impossible to accomplish, resulting in considerable inconvenience.

Contrastively, when the weight is transported, and the hoisting hook (including the upper section chain or steel cable) at the upper extent of the hoisting ring twists around as the lifted weight P is moved, the original position of the weight P varies with the rotation of the chain or steel cable at the upper extent of the hoisting hook because of the impeded state of each component, resulting in extreme inconvenience in that a worker cannot operationally transport the weight P to the exact, expected final position.

SUMMARY OF THE INVENTION

The primary objective of the invention herein is to provide an improved structure hoist-use base hoisting ring, wherein an annular recess is disposed along the top surface and center section of the cylindrical base mount that provides for the nesting of a flat planar bearing; the center portion opening of the planar bearing is sleeved over the periphery of the neck of the bottom mounting bushing such that its top surface is against the circular top mounting bushing bottom side, enabling the lifting of the load of the weight at the bottom end of the hoisting ring, and since the planar bearing so postured has active rotating capability, the hoisting ring lifting the weight is adequately capable of independent adjustment and rotation in regards to positioning; and provides workers the means to accurately position the weight following transport and has optimized operating convenience, which is among the features of the present invention.

Another objective of the invention herein is to provide an improved structure hoist-use base hoisting ring, wherein due to the rotative twisting of the hoisting hook (including the upper section chain or steel cable) at the upper extent of the hoisting ring that results in the spinning of the lifted weight, the reciprocal turning of the centrally postured planar bearing having active rotating capability enables the weight to be maintained at its original expected position as it is lifted and transported, which is also among the features of the present invention.

The brief description of the drawings below is followed by the disclosure of the structural embodiments and utilization examples of the invention herein.

BRIEF DESCRIPTION OF THE DRAWINGS

FIG. 1 is a cross-sectional drawing of the prior art structure.

FIG. 4-A is a cross-sectional drawing of the structural embodiment of the invention herein.

FIG. 4-B is a cross-sectional drawing of the structural embodiment of the invention herein.

DETAILED DESCRIPTION OF THE PREFERRED EMBODIMENTS

Figure 2:
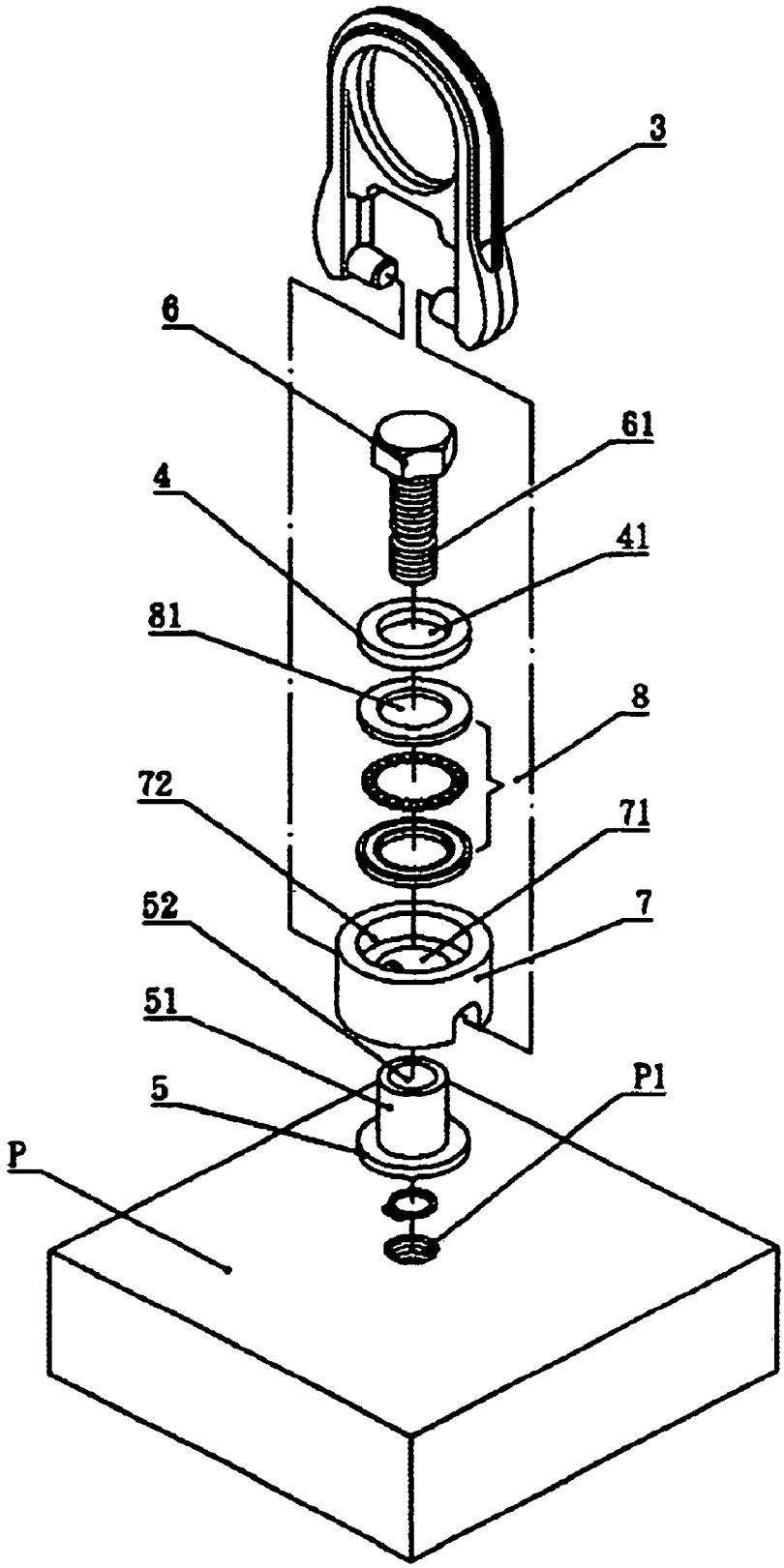
FIG. 2 is an exploded drawing of the structural embodiment of the invention herein.
Figure 3:
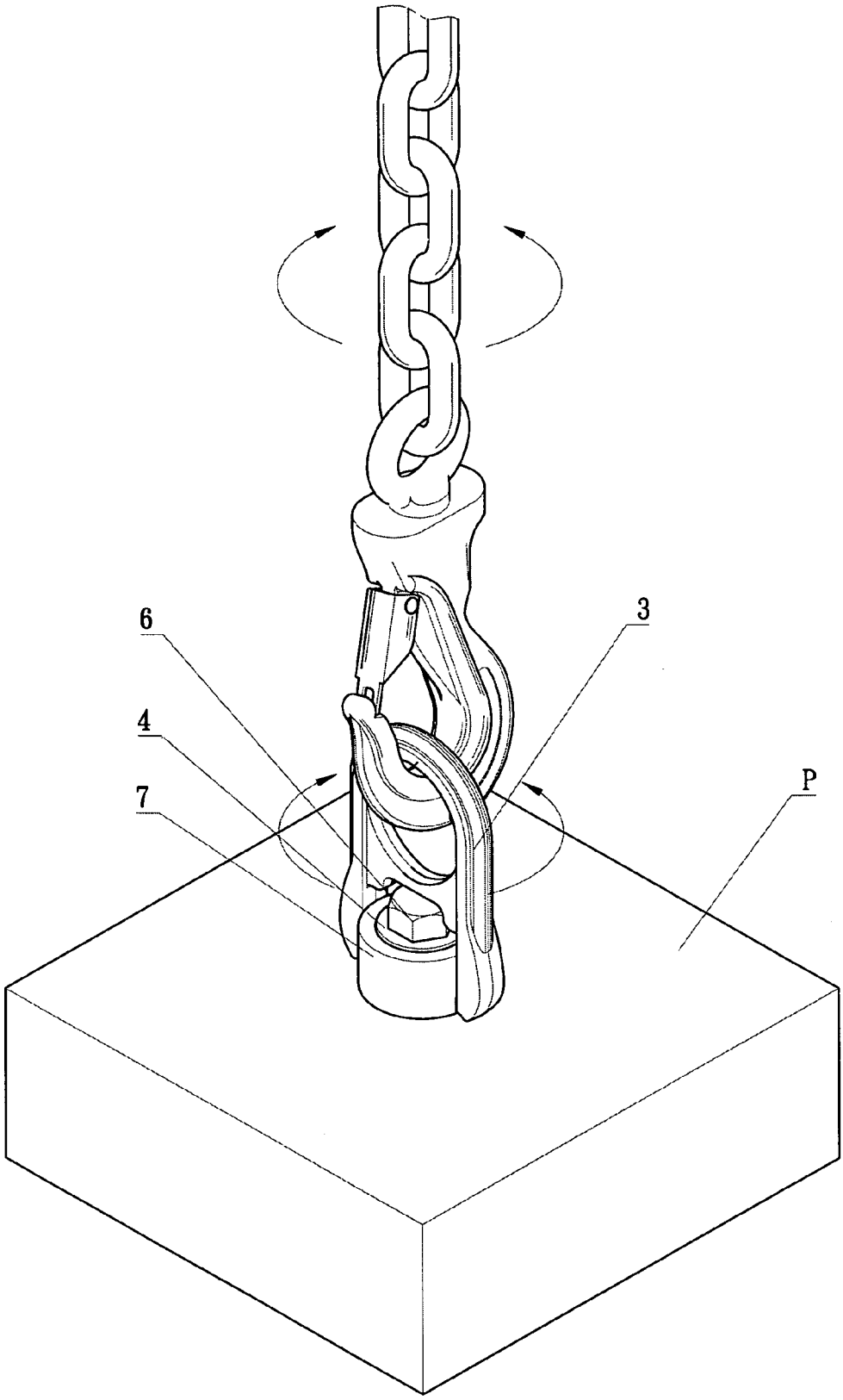
FIG. 3 is an isometric drawing of the structural embodiment of the invention herein.

Referring to FIG. 2 and FIG. 3, the invention herein consists of a U-shaped clevis 3 movably suspended from the two sides at the lower end of a cylindrical base mount 7 as well as a circular top mounting bushing 4 at the upper section and a bottom mounting bushing 5 at the center section having an upwardly projecting neck 51 and a passageway 52 that are situated over the top and bottom lateral surfaces of the bore 71 through the interior portion of the cylindrical base mount 7, enabling the installation of a bolt 6 into the top mounting bushing 4 center section and downward through the bottom mounting bushing 5 and the fastening of its threaded section 61 into the threaded hole P1 of a weight P at the lower end, wherein the structural features of the invention herein are:

An annular recess 72 is disposed along the top surface and center section of the cylindrical base mount 7 that provides for the nesting of a flat planar bearing 8; the center portion opening 81 of the planar bearing 8 is sleeved over the periphery of the bottom mounting bushing 5 neck 51 such that its top surface is against the circular top mounting bushing 4 bottom side, enabling the hoisting ring structure of the invention herein to lift the load of the weight P via a hoisting hook (including the upper section chain or steel cable) at the upper extent; since the planar bearing 8 is postured between the top mounting bushing 4 and the cylindrical base mount 7 and is adequate to provide for withstanding the "vertical downward pulling force" produced by the heaviness of the weight P; due to the "horizontally oriented" active rotating capability of the planar bearing 8, when rotative twisting occurs (as shown in FIG. 4-A) along the hoisting hook (including the upper section chain or steel cable) at the upper extent of the hoisting ring, the weight P lifted by the hoisting ring is unaffected by the reverse momentum and remains in its original position and state; and given that the hoisting hook (including the upper section chain or steel cable) at the upper extent of the hoisting ring does not move about (as shown in FIG. 4-B), workers can effectively bring the weight B to a required location in a convenient operation that is adjustable and freely rotatable.

Figure 5:
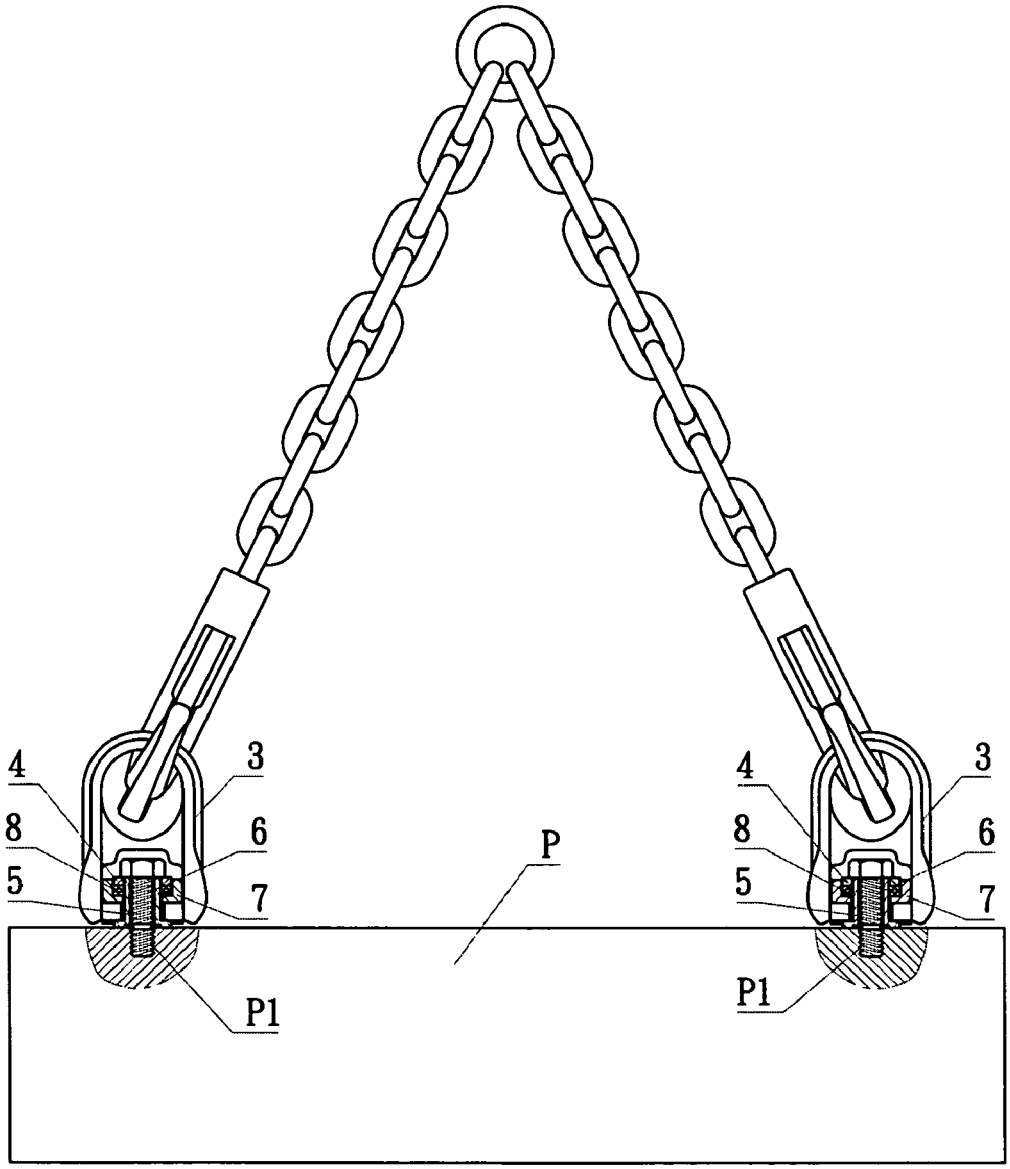
FIG. 5 is a cross-sectional drawing of another structural embodiment of the invention herein.

Referring to FIG. 5, the weight P can be utilized in a range of different embodiments in which a plurality of base hoisting rings are collectively lifted and since each has a planar bearing 8 that provides for the "horizontally oriented" active rotational adjustment capability of each weight P, the suspending hoisting hooks and chain or steel cables at the upper extent of each hoisting ring are level and efficient.

In summation of the foregoing section, since the invention herein is capable of improving hoist-use base hoisting ring utility, the present invention meets new patent application requirements.

The invention claimed is:

1. A hoist-use hoisting ring structure comprising: a U-shaped clevis movably suspended from the two sides at the lower end of a cylindrical base mount as well as a circular top mounting bushing at an upper section and a bottom mounting bushing at a center section having an upwardly projecting neck and a passageway that are situated over top and bottom lateral surfaces of a bore through the interior portion of the cylindrical base mount, enabling the installation of a bolt into the top mounting bushing and the fastening and positioning of a threaded section into a threaded hole of a weight at the lower end, wherein an annular recess is disposed along the top surface and center section of the cylindrical base mount that provides for the nesting of a flat planar bearing; a center portion opening of the planar bearing is sleeved over the periphery of the neck of the bottom mounting bushing such that the top surface is against the circular top mounting bushing bottom side, enabling a hoisting ring structure of the invention herein to lift the load of the weight; since the planar bearing is postured between the top mounting bushing and the cylindrical base mount, adequately providing for a active rotating capability, the weight being lifted is unaffected by the reverse momentum along the upper extent of the hoisting ring and capable of freely rotating, convenient operation.

* * * * *